US011845593B2

(12) United States Patent
Felice

(10) Patent No.: US 11,845,593 B2
(45) Date of Patent: Dec. 19, 2023

(54) PACKAGING SYSTEM AND METHOD

(71) Applicant: SECURE HARD DRIVE DESTRUCTION PTY LTD, East Keilor (AU)

(72) Inventor: Daniel Rocco Felice, East Keilor (AU)

(73) Assignee: SECURE HARD DRIVE DESTRUCTION PTY LTD, East Keilor (AU)

( * ) Notice: Subject to any disclaimer, the term of this patent is extended or adjusted under 35 U.S.C. 154(b) by 105 days.

(21) Appl. No.: 17/635,281

(22) PCT Filed: Aug. 13, 2020

(86) PCT No.: PCT/AU2020/050845

§ 371 (c)(1),
(2) Date: Feb. 14, 2022

(87) PCT Pub. No.: WO2021/026612

PCT Pub. Date: Feb. 18, 2021

(65) Prior Publication Data

US 2022/0289424 A1 Sep. 15, 2022

(30) Foreign Application Priority Data

Aug. 13, 2019 (AU) ..... 2019216627

(51) Int. Cl.
*B65D 5/36* (2006.01)
*B65D 5/02* (2006.01)
(Continued)

(52) U.S. Cl.
CPC ..... *B65D 5/36* (2013.01); *B65D 5/0236* (2013.01); *B65D 5/326* (2013.01); *B65D 5/643* (2013.01);
(Continued)

(58) Field of Classification Search
CPC ..... B65D 5/36; B65D 5/0236; B65D 5/326; B65D 5/643; B65D 19/20;
(Continued)

(56) References Cited

U.S. PATENT DOCUMENTS 1,911,339 A 5/1933 Andrews
4,549,673 A 10/1985 Kupersmit
(Continued)

OTHER PUBLICATIONS

Written Opinion and International Search from corresponding AU application No. PCT/AU2020/050845 dated Oct. 15, 2020.
(Continued)

*Primary Examiner* — Christopher R Demeree
(74) *Attorney, Agent, or Firm* — Vorys, Sater, Seymour and Pease LLP

(57) ABSTRACT

A packaging system includes an inner box and an outer box. The inner box is adapted to receive items to be transported and has a base, a side wall and a lid. The outer box is adapted to house the inner box and has a base, a side wall and a lid. The base and the lid of the outer box are adapted to form a flat pack that houses a folded-down form of the inner box and of the side wall of the outer box for transport within the flat pack. The folded-down form of the inner box can be removed from the flat pack and assembled to form the inner box. The folded down form of the side wall of the outer box can be removed from the flat pack and assembled together with the base and the lid of the outer box to form the outer box.

19 Claims, 12 Drawing Sheets

(51) Int. Cl.
*B65D 5/32* (2006.01)
*B65D 5/64* (2006.01)
*B65D 19/20* (2006.01)

(52) U.S. Cl.
CPC ..... *B65D 19/20* (2013.01); *B65D 2519/0091* (2013.01); *B65D 2519/00159* (2013.01); *B65D 2519/00273* (2013.01); *B65D 2519/00333* (2013.01); *B65D 2519/00502* (2013.01); *B65D 2519/00597* (2013.01); *B65D 2519/00641* (2013.01); *B65D 2519/00711* (2013.01)

(58) Field of Classification Search
CPC ..... B65D 2519/00159; B65D 2519/00273; B65D 2519/00333; B65D 2519/00502; B65D 2519/00597; B65D 2519/00641; B65D 2519/00711; B65D 2519/0091; B65D 2519/00293; B65D 19/06; B65D 81/3825
USPC ..... 229/117.01, 117.02, 122.32, 117.05; 206/600; 220/8; 222/105, 183
See application file for complete search history.

(56) References Cited

U.S. PATENT DOCUMENTS 4,606,461 A * 8/1986 Bolton, Sr. ..... B65D 19/20 229/117.02
4,880,141 A * 11/1989 Gossler ..... B65D 19/20 229/122.23
4,887,764 A 12/1989 Ogura
5,071,010 A * 12/1991 Carufel/Zeman ..... B65D 19/06 229/199
5,090,614 A * 2/1992 Kupersmit ..... B65D 5/36 229/117.04
6,032,815 A * 3/2000 Elstone ..... B65D 77/061 220/666
8,950,656 B2 * 2/2015 Nebeker ..... B65D 5/425 229/162.1
10,954,025 B2 * 3/2021 Rozek ..... B65D 5/4266
2007/0227937 A1 * 10/2007 Higgins ..... B65D 19/12 206/600
2008/0035717 A1 * 2/2008 Turvey ..... B65D 11/186 229/117.02
2011/0308993 A1 * 12/2011 Hill ..... B65D 19/20 493/122

OTHER PUBLICATIONS

Kite Packaging—How to assemble our Corrugated Pallet Boxes [Viewed on internet on Oct. 13, 2020] Viewed on Internet. URL: https://www.youtube.com/watch?v=qb9d2kcVsr8 >, Published on Apr. 15, 2015.
Sadlers Cartons—How to Assemble a Pallet Box (BE065/BE165/PP009/PP010)[Viewed on internet on Oct. 13, 2020] Viewed on internet. URL: https://www.youtube.com/watch?v=4da9iBEE4eg >, Published on Feb. 3, 2014.

* cited by examiner

PACKAGING SYSTEM AND METHOD

FIELD

The present invention relates to a packaging system and to a method of packaging items.

In particular, although by no means exclusively, the present invention relates to a packaging system and to a method for securely storing and/or transporting items containing sensitive or confidential data.

BACKGROUND

Storage and transportation of items are everyday necessities for many commercial and private entities.

Generally, for smaller and lighter items, cardboard boxes or plastic/metal containers are used to collect and move items.

Carboard boxes are light and foldable, however, they are generally not suitable for transportation of heavier items.

On the other hand, plastic/metal containers are robust and can bear the weight of heavier items. However, these types of containers cannot generally be folded-down when empty and are relative heavy. As a consequence, plastic/metal containers are difficult to transport to the locations where items are stored and they have a significant impact on the weight of the final packed items to be transported.

Additionally, for many private and commercial entities, it is important that the containers be securely closed during transit and that the contents be inaccessible by unauthorized people, particularly if the stored and transported items contain sensitive and confidential data.

Strips of packing tape around containers provide some form of security, but they do not provide a high level of security because they can be easily compromised to allow access to containers, often in an untraceable way.

There is a need for an alternative storing and transportation method that is secured and easy to handle.

The above description is not to be taken as an admission of the common general knowledge in Australia and elsewhere.

SUMMARY OF INVENTION

The present invention provides a packaging system including:

(a) an inner box that is adapted to receive items to be transported, the inner box including a base, a side wall and a lid, and (b) an outer box that is adapted to house the inner box, the outer box including a base, a side wall and a lid, wherein the base and the lid of the outer box are adapted to form a flat pack that houses a folded-down form of the inner box and a folded-down form of the side wall of the outer box for transport within the flat pack, whereby in use the folded-down form of the inner box is removed from the flat pack and assembled to form the inner box and the folded-down form of the side wall of the outer box is removed from the flat pack and assembled together with the base and the lid of the outer box to form the outer box.

In some embodiments, the side wall of the outer box is in the form of a sleeve that includes a plurality of side wall panels separated by fold lines, wherein the side wall panels can be folded flat and can also be erected to define the side wall of the outer box.

In some embodiments, the base of the outer box includes a base panel and a perimeter wall extending from an outer edge of the base panel.

In some embodiments, the dimensions of the base of the outer box and the side wall of the outer box are selected so that the side wall of the outer box can be inserted into and received within the perimeter wall of the base of the outer box.

In some embodiments, the lid of the outer box includes a lid panel and a perimeter wall extending from an outer edge of the lid panel.

The dimensions of the perimeter wall of the lid of the outer box and the dimensions of the side wall of the outer box may be selected so that the lid can be positioned to close the outer box with the perimeter wall of the lid located outwardly of the side wall of the outer box.

In some embodiments, the dimensions of the perimeter wall of the base of the outer box and the perimeter wall of the lid of the outer box are selected so that the lid can be positioned on the base to form the flat pack with the perimeter wall of the lid located outwardly of the perimeter wall of the base.

In some embodiments, the side wall of the inner box is in the form of a sleeve that includes a plurality of side wall panels separated by fold lines, wherein the side wall panels can be folded flat and can also be erected to define the side wall of the inner box.

In some embodiments, the base of the inner box includes base panels extending from side wall panels of the side wall of the inner box and separated from the side wall panels by fold lines, the base panels being adapted to be folded to form the base of the inner box.

The lid of the inner box may include lid panels extending from the side wall panels of the side wall of the inner box, the lid panels being adapted to be folded to form the base of the inner box.

The present invention also provides a method of packaging items, the method comprising:

(a) opening the flat pack of the packaging system defined in any one of the preceding claims either before or after step (b);

(b) assembling together the base of the inner box and the side wall of the inner box of the packaging system defined in any one of the preceding claims, so that the side wall of the inner box extends upwardly form the base of the inner box to form a partially assembled inner box;

(c) assembling together the base of the outer box and the side wall of the outer box of the packaging system defined in any one of the preceding claims, so that the side wall of the outer box extends upwardly form the base of the outer box to form a partially assembled outer box;

(d) inserting the partially assembled inner box described in step (b) in the partially assembled outer box described in step (c) either before or after step (e), (e) positioning items to be transported in the partially assembled inner box and closing the inner box with the lid of the inner box, and (f) closing the partially assembled outer box with the lid of the outer box.

Step (b) may comprise assembling the inner box by unfolding and opening the folded-down form of the inner box to form a tube and folding the base panels of the inner box to form the base of the inner box, thereby defining an erected form of the side wall of the inner box.

Step (c) may comprise assembling the outer box by opening the side wall of the outer box from the folded-down form to an erected form and inserting the side wall into the base of the outer box.

In some embodiments, the method further comprises, after step (b), securing together the base of the inner box and the side wall of the inner box with a fastener.

In some embodiments, the method further comprises, after step (e), securing together the lid of the inner box and the side wall of the inner box with a fastener.

In some embodiments, the method further comprises, after step (e), securing together the lid of the inner box and the side wall of the outer box with a fastener.

In some embodiments, the method further comprises, after step (f), securing together the base of the outer box, the lid of the outer box and the side wall of the outer box with a fastener.

The present invention also provides packaged items in a closed inner box positioned within a closed outer box formed from the packaging system defined above and/or in accordance with the method defined above.

The present invention also provides a flat pack comprising the packaging system described above.

Advantages and other features of the invention will become apparent from the following drawing, description and claims.

BRIEF DESCRIPTION OF THE DRAWINGS

In order that the invention may be more clearly ascertained, embodiments of the invention are now described, by way of example, with reference to the accompanying drawing, in which:

FIG. 12(*b*) is a side view of the inner box in a partially close configuration;

FIG. 12(*c*) is a top view of the tube of the blank material shown in FIG. 12(*a*) in a folded-down form;

FIG. 13(*b*) is a front view of the outer box;

FIG. 13(*c*) is a side view of the outer box;

FIG. 13(*d*) is a bottom view of the outer box;

FIG. 14(*b*) is a top view of the side wall of the outer box in a folded-down form;

FIG. 14(*c*) is a front view of the side wall of the outer box;

FIG. 15(*b*) is a front view of the base of the outer box;

FIG. 15(*c*) is a bottom view of the base of the outer box;

FIG. 16(*b*) is a front view of the lid of the outer box;

FIG. 16(*c*) is a side view of the lid of the outer box; and

FIG. 16(*d*) is a bottom view of the lid of the outer box.

DETAILED DESCRIPTION

Referring to the Figures a packaging system 10 according to an embodiment of the present invention includes an inner box 20 and an outer box 30. The packaging system 10 is suitable for use for storing and/or transporting items 60, in particular, but not exclusively, items containing sensitive or confidential data.

Figure 1:
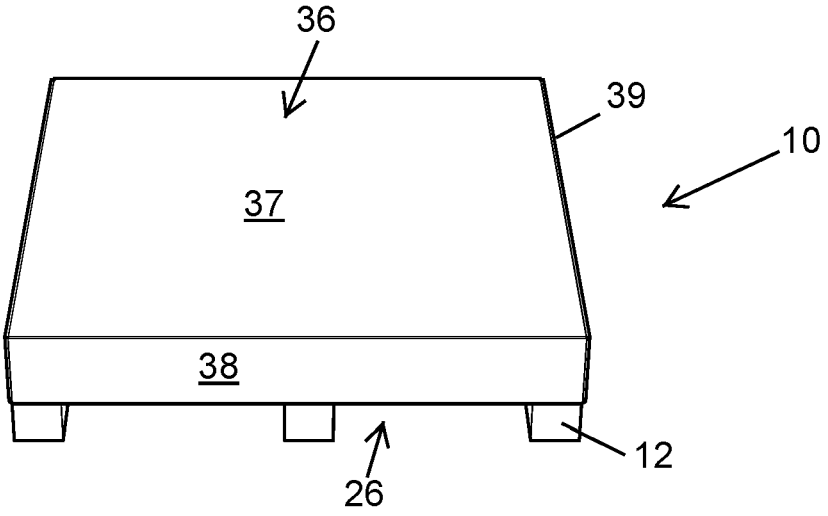
FIG. 1 is a perspective view of a packaging system according to an embodiment of the invention in the form of a flat pack in a closed configuration.

FIG. 1 shows the packaging system 10 in the form of a flat pack in a closed configuration sitting on a pallet 12 (noting that the Figure only shows three parallel bearers of the pallet).

The closed flat pack shown in FIG. 1 houses folded-down forms of the inner box 20 and a side wall 40 of the outer box 30 as described in more detail below and noting that the folded-down form of the inner box 20 shown in FIGS. 2 and 12(*c*) is one of a number of configurations of the inner box 20.

Figure 2:
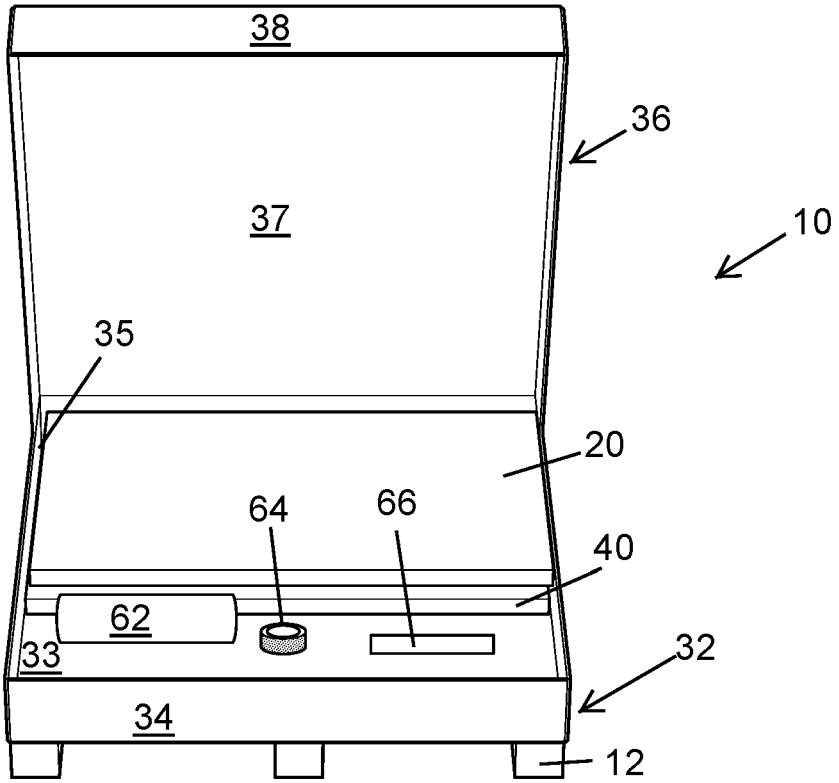
FIG. 2 is a perspective view of the packaging system of FIG. 1 in the form of a flat pack in an open configuration.

FIGS. 1 and 2 show the closed flat pack and the pallet 12 as being separate items. However, in some embodiments the packaging system 10 includes the pallet 12, which is attached to or incorporated in the base of the outer box 30.

FIG. 2 shows the flat pack in an open configuration. The Figure shows that the flat pack is formed by a base 32 of the outer box 30 and a lid 36 of the outer box 30 and houses folded down forms of the inner box 20 and a folded down form of the side wall 40 of the outer box 30.

In the described embodiment, the lid 36 of the outer box 30 includes a lid panel 37 and a perimeter wall 38 extending from an outer edge 39 of the lid panel 37. Similarly, a base panel of the outer box 30 includes a base panel 33 and a perimeter wall 34 extending from an outer edge 35 of the base panel 33.

The dimensions of the perimeter wall 34 of the base 32 of the outer box 30 and the perimeter wall 38 of the lid 36 of the outer box 30 are selected so that the lid 36 can be positioned on the base 32 of the outer box 30 with the perimeter wall 38 of the lid 36 located outwardly of the perimeter wall 34 of the base 32 to form the closed flat pack, as shown in FIG. 1.

In the described embodiment shown in FIG. 2, the packaging system 10 further includes a wrap 62, a tape 64, and seals 66. These optional accessories provide additional fastening and security means for closing one or both of the inner box 20 and the outer box 30 as explained in more detail below.

It is evident from FIGS. 1 and 2 that the flat pack is a compact form and components of the inner box 20 and the outer box 30 that are housed in the flat pack are efficiently and effectively housed in the flat pack.

In order to store and transport items 60 using the packaging system 10 according to the present invention, a user first opens the flat pack of the packaging system 10 and extracts the folded down form of the inner box 20 and the side wall 40 of the outer box 30. The user then performs the following steps:

(i) assembles together a base 22 and a side wall 50 of the inner box 20 so that the side wall 50 extends upwardly form the base 22;

(ii) assembles together the base 32 and the side wall 40 of the outer box 30 so that the side wall 40 extends upwardly form the base 32, (iii) inserts the assembled components of the inner box 20 described in item (i) into the assembled components of the outer box 30 described in item (ii);

(iv) positions items 60 to be transported in the inner box 20 and closes the inner box 20 with a lid 26 of the inner box 20; and (v) closes the outer box 30 with a lid 36 of the outer box 30.

Step (i) and (ii) can be performed in reverse order.

Step (iii) and (iv) can also be performed in reverse order.

The above steps are described in more detail below with reference to FIGS. 3 to 10.

Figure 3A:
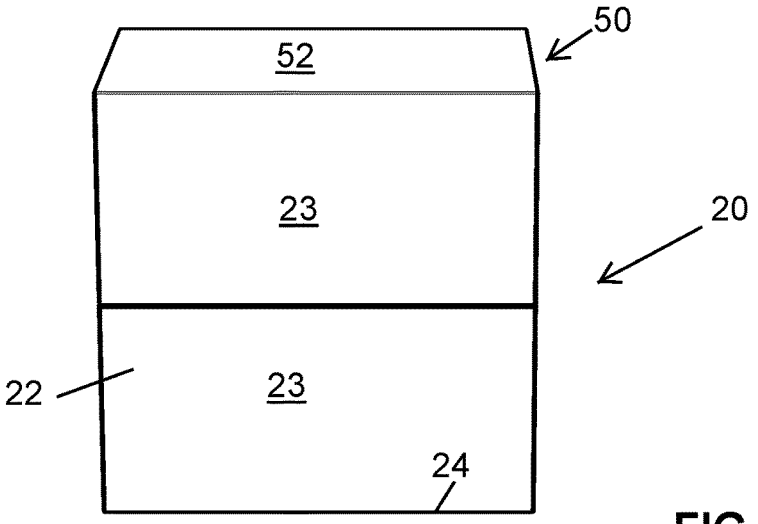
FIGS. 3(*a*) and 3(*b*) are bottom views and FIG. 3(*c*) is a perspective view of an inner box of the packaging system of FIGS. 1 and 2.
Figure 3B:
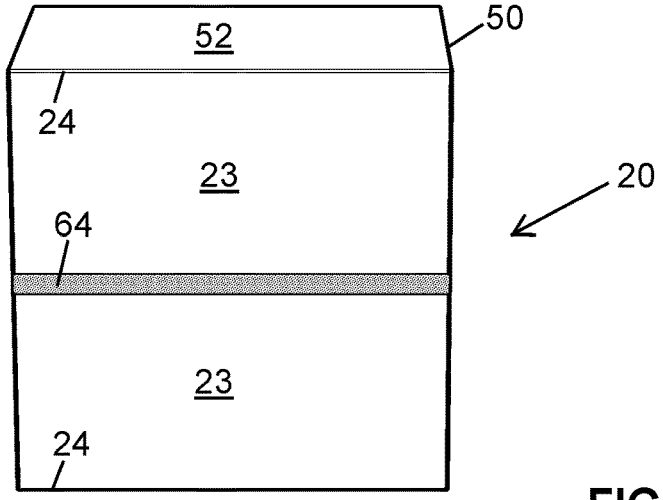
Figure 3C:
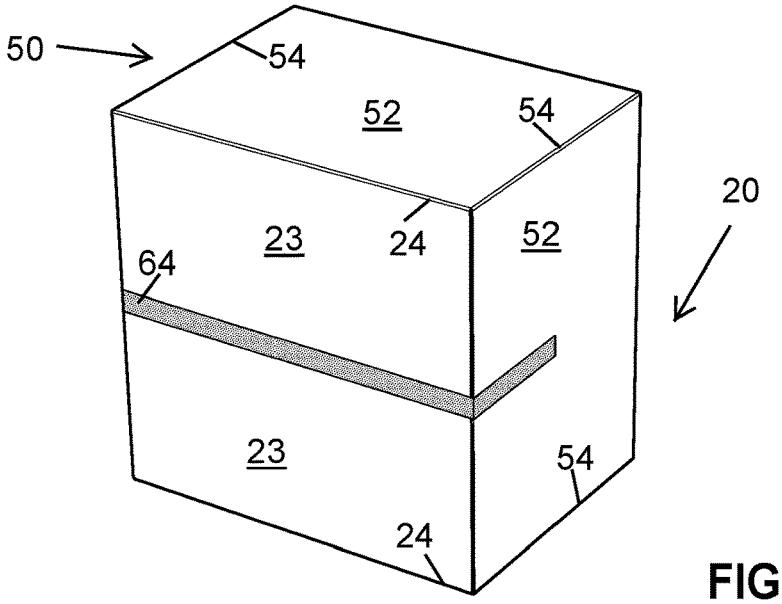

FIGS. 3(*a*) and 3(*b*) are bottom views and FIG. 3(*c*) is a perspective view of an inner box 20 of the packaging system.

Figure 12:
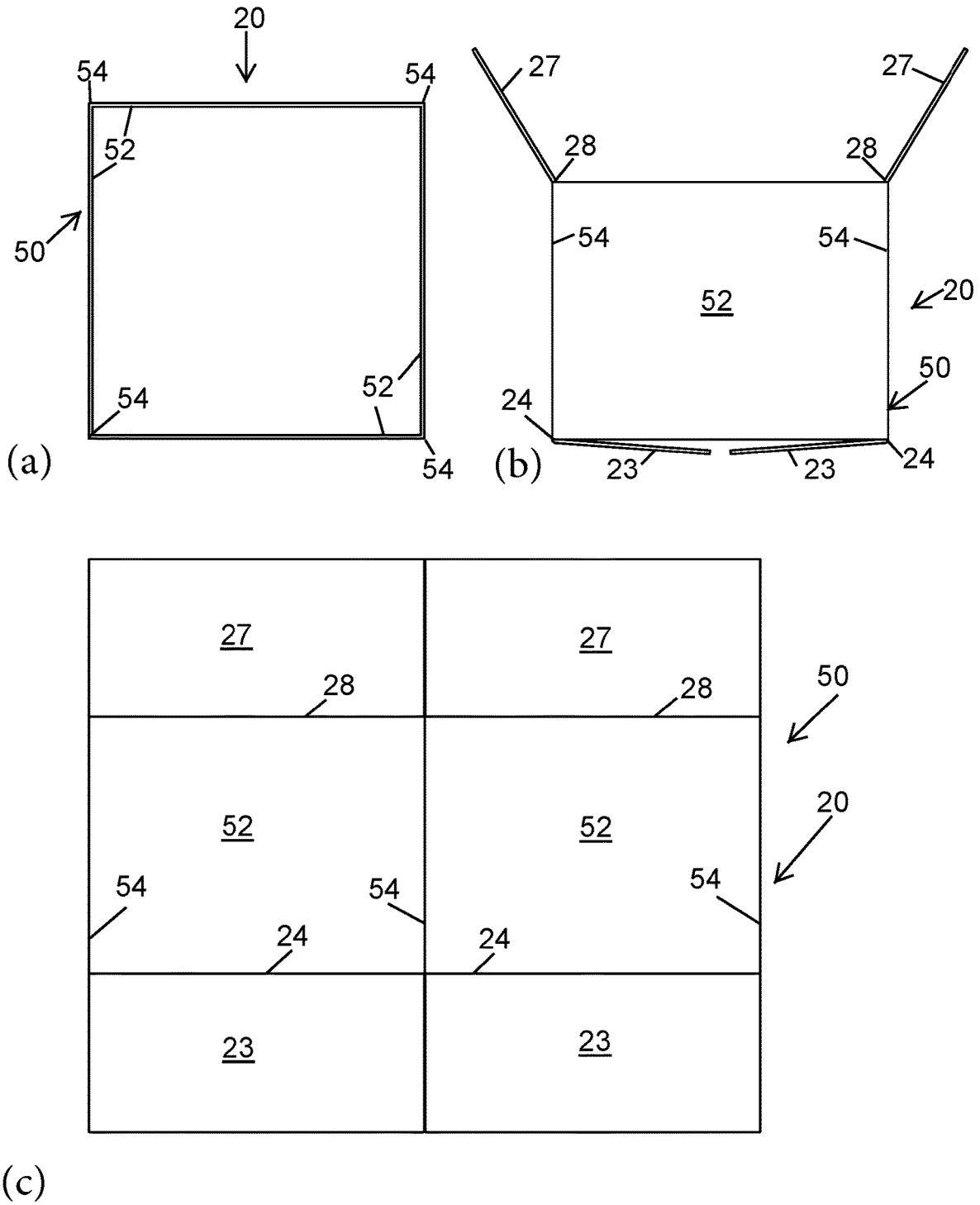
FIG. 12(*a*) is a top view of a tube of a blank of a material, such as cardboard, from which the inner box is formed, with the tube comprising aligned side wall panels, lid panels and base panels.

Referring to these Figures (and noting the further description in relation to FIG. 12(*c*)), the inner box 20 is formed from a flat blank of a suitable material, typically a cardboard material, that comprises a plurality of side wall panels 52, base panels 23, and lid panels 27 (see FIG. 12(*c*)) separated by fold lines. In a manufacturing operation, the blank is folded so that opposed long side edges of the blank are brought into contact and connected together to form an elongate tube. FIG. 12(*c*) shows a flattened form of the tube.

With further reference to FIGS. 3(*a*) to (*c*), the side wall 50 of the inner box 20 comprises four side wall panels 52 separated by fold lines 54 and the base 22 comprises four base panels 23 connected via fold lines 24 to adjacent side wall panels 52. Only two base panels 23 are visible in FIGS. 3(*a*) to 3(*c*). The other two base panels 23 are concealed in the assembled inner box 20.

Figure 6:
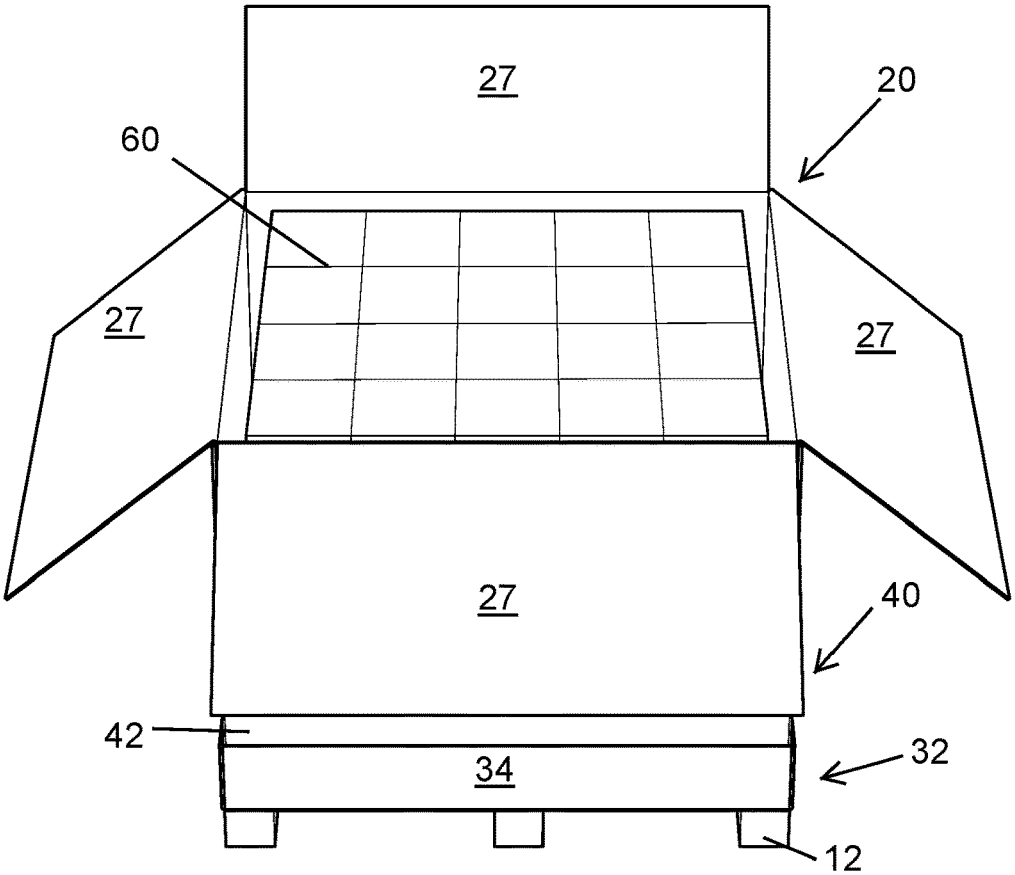
FIG. 6 is another perspective view of the inner box and the outer box as shown in FIG. 5 including items to be stored and/or transported in the inner box.

As can best be seen in FIG. 6, the lid of the inner box 20 comprises four lid panels 27 connected via fold lines to adjacent side wall panels 52.

The described embodiment has four side walls panels 52. However, in other embodiments, the side wall 50 of the inner box 20 includes fewer or more side wall panels.

Figure 5:
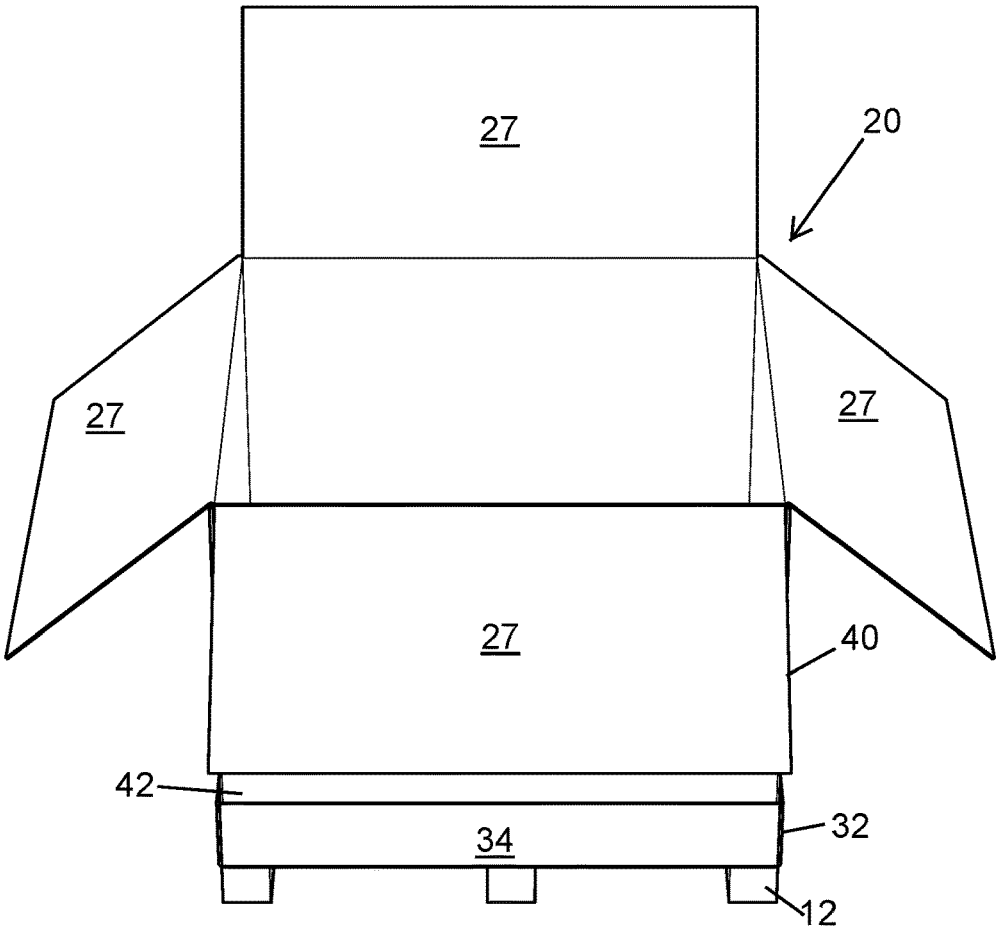
FIG. 5 is a perspective view of the outer box shown in FIG. 4 with the inner box inserted into the outer box, the inner box being in an open configuration to receive items to be stored and/or transported.

In the described embodiment, assembling the base 22 and the side wall 50 of the inner box 20 comprises erecting the inner box 20 by opening the sleeve from the folded-down form shown in FIG. 12(*c*) to define the erected side wall 50 of the inner box 20 and folding the base panels 23 to form the base 22 of the inner box 20, with the lid panels 27 being folded outwardly as shown in FIGS. 5 and 6 to allow access to the interior of the inner box 20.

FIG. 3(*a*) shows a bottom view of the inner box 20 in an assembled form with the base 22 comprising the two adjacent base panels 23 extending from opposite side wall panels 52 of the inner box 20. FIGS. 3(*b*) and 3(*c*) show the assembled inner box 20 with the two base panels 23 secured together by a fastener 64 thereby forming a closed base 22 for the inner box 20.

In the described embodiment, the two base panels 23 are secured together by a strip of tape 64, optionally included in the flat pack 10. The fastener 64 may, however, be any suitable means that secures the two base panels 23 together in a realisably or permanent form.

In some embodiments, multiple strips of tape are used and in other embodiments no strips of tape are used.

In the embodiment shown in FIG. 3(*c*) the fastener 64 is a continuous strip of tape that extends from one side of the side wall 52 of the inner box 20 to the opposite side of the side wall 52 of the inner box 20, thereby securing together the base 22 and the side wall 52 of the inner box 20. In particular, the strip of tape 64 is applied starting approximately half way down one side of the inner box 20, continuing across the base 22 of the inner box 20 and ending approximately half way down the other side of the inner box 30.

However, in some embodiments the strip of tape 64 is discontinuous and/or is limited to the base 20. For example, in some embodiments the strip of tape 64 is segmented, with segments of tape being continuous only across different parts of the inner box 20. For example, the strip of tape 64 may be continuous starting from different parts of the base 22 until half way through one or more side panels 52 of the side wall 50 of the inner box 20.

In some embodiments seals (not shown) are applied on the left side, the right side and the bottom of inner box 20 after the strip of tape 64 is applied. The seals, in some embodiments, contain numerical or alpha numerical sequences that can be recorded as a proof that the inner box 20 and/or the outer box 30 has/have or has/have not been opened. The seals partially overlap with the strip (s) of tape 64.

Figure 4:
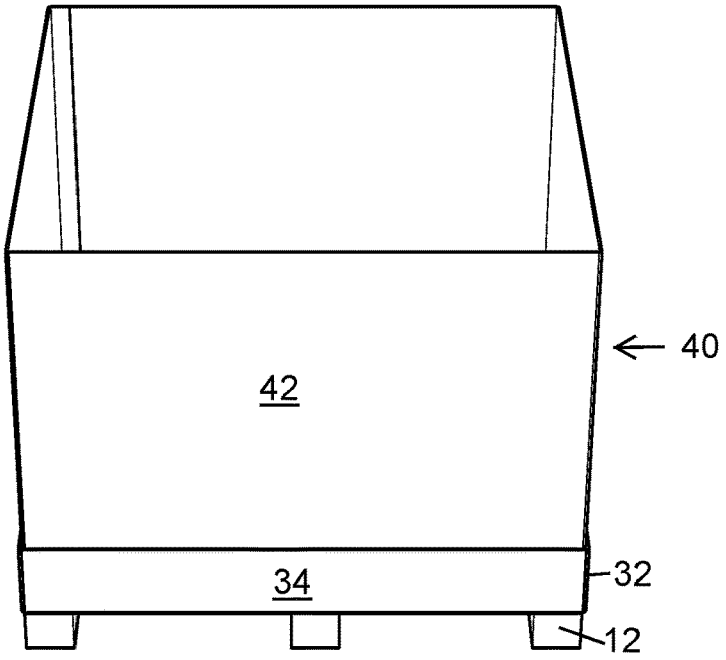
FIG. 4 is a perspective view of an outer box of the packaging system without the lid of the outer box.

FIG. 4 shows the partially assembled outer box 30. In the described embodiment, assembling the outer box 30 comprises erecting the outer box 30 by opening the sleeve from the folded-down form to define the erected side wall 40 of the outer box 30 and inserting the side wall 40 into the base 32 of the outer box 30.

The base of the outer box 30 includes a base panel 33 and a perimeter wall 34 extending from an outer edge 35 of the base panel 33.

The dimensions of the base 32 of the outer box 30 and the side wall 40 of the outer box 30 are selected so that the side wall 50 of the outer box 30 can be inserted into and received within the perimeter wall 34 of the base 32 of the outer box 30.

FIG. 5 shows the inner box 20 inserted into the outer box 30 in an open configuration for receiving items 60 to be store and transported. As evident from the Figure, the lid panels 27 of the inner box 20 are folded outwardly to allow access to the interior of the inner box 20.

The dimensions of the side wall 40 and the base 32 of the outer box 30 and of the side wall 50 and the base 22 of the inner box 20 are selected so that inner box 20 is received snugly within the outer box 30.

Figure 7:
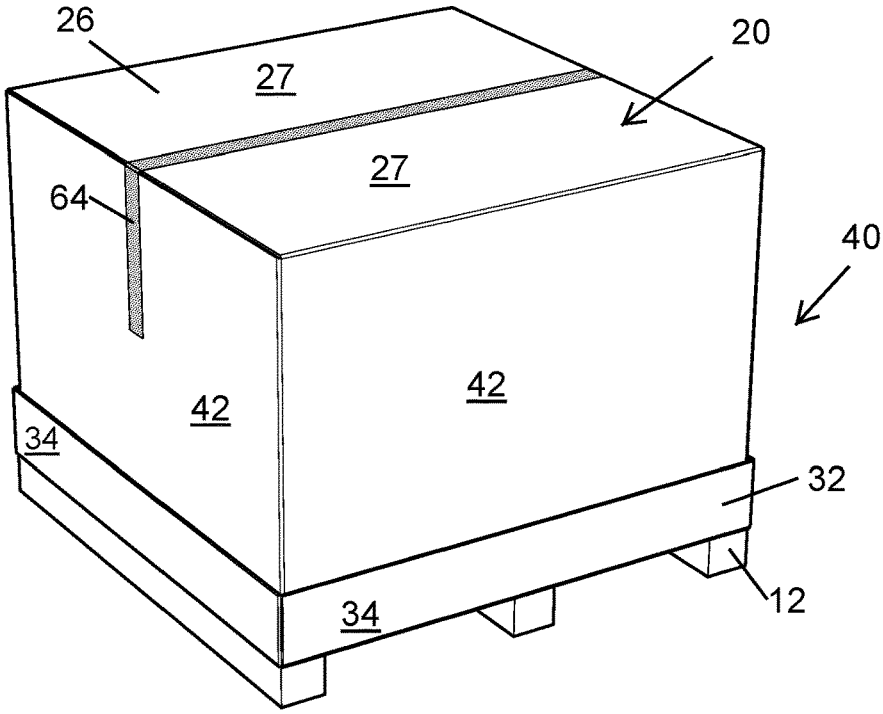
FIG. 7 is another perspective view of the inner box and the outer box as shown in FIGS. 5 and 6 with the inner box in a closed configuration.

FIG. 6 is very similar to FIG. 5 and shows the items 60 to be transported positioned in the inner box 20 before the inner box 20 is closed as shown in FIG. 7.

FIG. 7 shows the inner box 20 positioned inside the outer box 30 with the lid panels 27 of the inner box 20 folded inwardly to close the inner box 20.

As noted above, the lid panels 27 of the inner box 20 extend from the side wall panels 52 of the side wall 50 of the inner box 20 and are adapted, by virtue of fold lines, to be folded to form the lid 26 of the inner box 20.

As noted above, in the described embodiment the lid 26 of the inner box 20 is formed by four lid panels 27. However, in other embodiments there are fewer or more lid panels 27.

Additionally, in the described embodiment the lid panels 27 have substantially the same shape and dimensions. However, in other embodiments the lid panels 27 have different shapes and dimensions. For example, in one embodiment, a lid panel 27 has the same or similar dimensions to a lid panel 27 extending from an opposite side wall panel 52 and different dimensions to a lid panel 27 extending from an adjacent side wall panel 52.

In still another embodiment, the lid 26 of the inner box 20 can be a unitary body that is not connected to the side wall panels 52 of the inner box 20 and can be positioned to cooperate with the side wall 50 of the inner box 20 to provide closure to the inner box 20.

FIG. 7 shows the outer box 30 housing the inner box 20, which is closed by lid panels 27 and a continuous strip of tape 64 running on the juncture of the two lid panels 27. The strip of tape 64 is applied starting approximately half way down one side of the outer box 30, continuing across the top of the inner box 20 and ending approximately half way down the other side of the outer box 30.

The strip of tape 64 secures the lid panels 27 together and at the same time the inner inbox 20 to the outer box 30.

In some embodiments, multiple strips of tape are used and in other embodiments no strips of tape are used.

FIG. 7 shows the fastening means as a continuous extending from one side of the side wall of the outer box to the opposite side of the side wall of the outer box across the lid of the inner box. However, in other embodiments, the strip of tape is discontinuous and/or is limited to the base. For example, in some embodiment the strip of tape 64 is segmented, with segments of tape being continuous only across different parts of the inner box 20 and the outer box 30. For example, the strip of tape 64 is continuous starting from different parts of the lid 26 of the inner box 20 to half way through one or more side panels 42 of the side wall 40 of the outer box 30.

However, in some embodiments the lid panels 27 together are first secured together and optionally to the side wall 50 of the inner box 20 by a fastener 64 thereby forming a closed lid 26 for the inner box 20. In an additional step the lid 26 of the inner box is secured to the outer box as described above.

In some embodiments, seals (not shown) are applied on and across the strip(s) of tape 64 as a proof that the inner box 20 and/or the outer box 30 has/have or has/have not been opened.

Once the inner box 20 containing the items 60 to be stored and/or transported is closed, the outer box 30 is closed by positioning a lid 36 that cooperates with the side walls 40 of the outer box 30.

Figure 8:
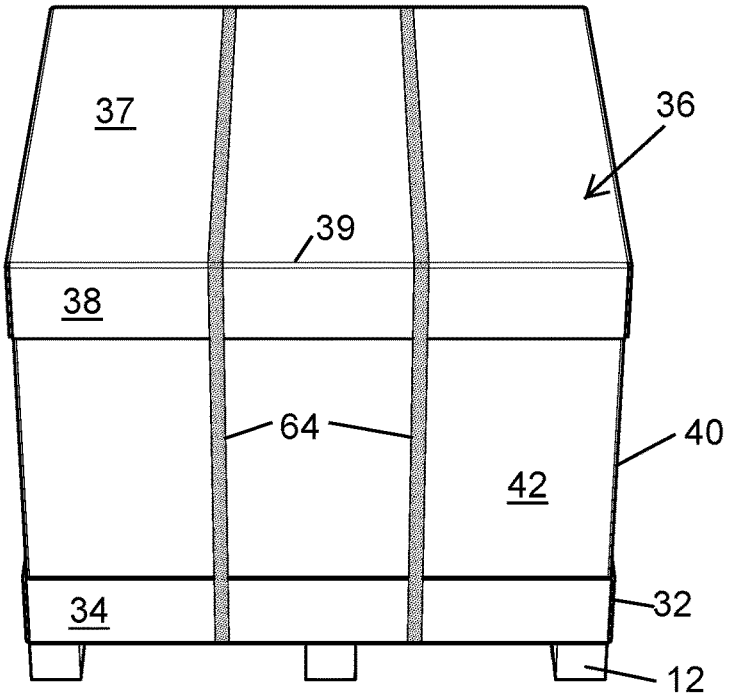
FIG. 8 is a perspective view of the outer box of FIGS. 4 to 7 including the lid.

In the embodiment described in FIG. 8, the lid 36 of the outer box 30 includes a lid panel 37 and a perimeter wall 38 extending around an outer edge 39 of the lid panel 37.

The dimensions of the perimeter wall 38 of the lid 36 of the outer box 30 and the dimensions of the side wall 40 of the outer box 30 are selected so that the lid 36 can be positioned to close the outer box 30 with the perimeter wall 38 of the lid 36 located outwardly of the side wall 40 of the outer box 30.

FIG. 8 also shows two continuous strips of tape 64 applied starting from underneath one side of the base 32 of the outer box 30, continuing along the side wall 40 and the lid 36 of the outer box 30 and ending underneath the other side of the base 32 of the outer box 30 (not shown).

The strips of tape 64 can be more than two or can be replaced by a single strip of tape. Also, in some embodiment the strip(s) of tape 64 are segmented, with segments of tape being continuous only across different parts of the outer box 30. For example, the strip of tape 64 is continuous starting from the base panel 33 till half way through the side wall 40 of the outer box 30 and/or from half way through the side wall 40 of the outer box 30 to the lid panel 37. In some embodiment, no strips of tape are used.

In some embodiments seals (not shown) are applied on and across the tape 64. The seals contain numerical or alpha numerical sequences that can be recorded as a proof that the inner box 20 and/or the outer box 30 has/have or has/have not been opened.

Figure 9:
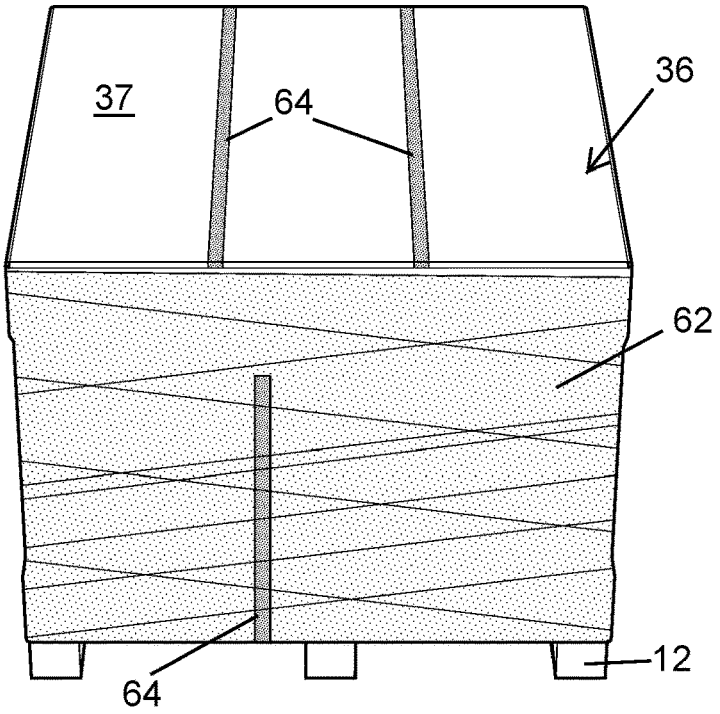
FIG. 9 is a perspective view of the outer box as shown in FIG. 8 wrapped in a plastic material.

In order to provide a further level of security for storage and transportation, the outer box 30 is wrapped in a plastic material 62 as shown in FIG. 9. A continuous layer of wrapping material 62 is laid along each side of the sidewall of the outer box 30 to also include, at least in part, the perimeter wall 38 of the lid 36, the outer edges 39 of the lid panel 37, the perimeter wall 34 of the base 32 and the outer edges 35 of the base panel 33. The tail of the wrapping material 62 is secured from unravelling by a strip of tape 64.

In some embodiments, seals (not shown) are applied on and across the tape 64. The seals contain numerical or alpha numerical sequences that can be recorded as a proof that the wrapping material 62 has not been unravelled.

In some embodiments, the wrapping material 62 further cover the lid 36 and/or the base 32 of the outer box 30.

In some other embodiments, the packaging method does not include the wrapping of the outer box 30.

In still some other embodiments, alternative solutions are used to further secure the base 32, the side wall 40 and the lid 36 of the outer box 30 together.

Figure 10:
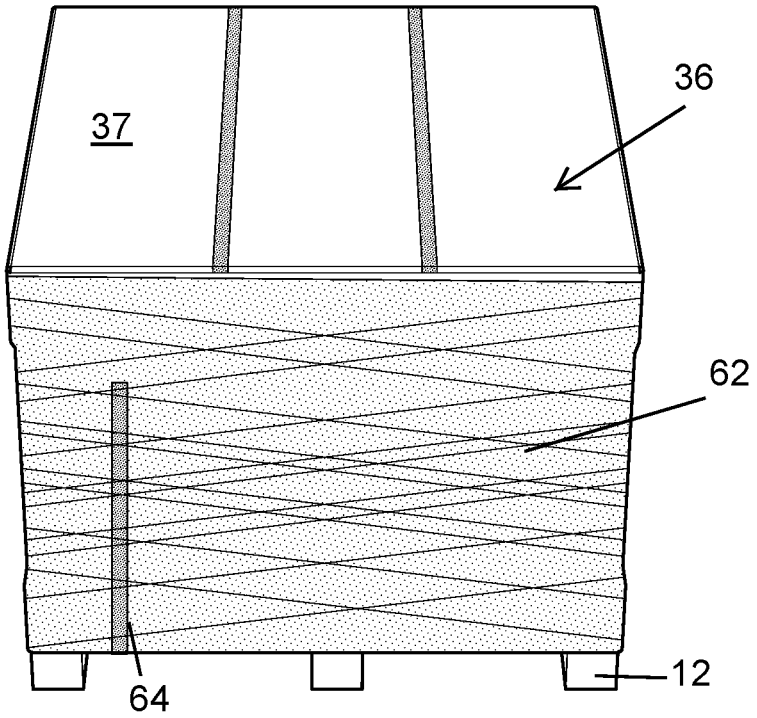
FIG. 10 is a perspective view of the outer box as shown in FIG. 9 wrapped in an additional plastic material.

In the embodiment shown in FIG. 10, a further layer of continuous wrapping material 62 is applied to the wrapped outer box 30 and a strip of tape 64 is applied to the tail of the wrapping material 62.

In some embodiments, the further layer of continuous wrapping material 62 cover the lid 36 and/or the base 32 of the outer box 30.

The step of wrapping the outer box 30 in a second layer of wrapping material 62 is optional.

Figure 11:
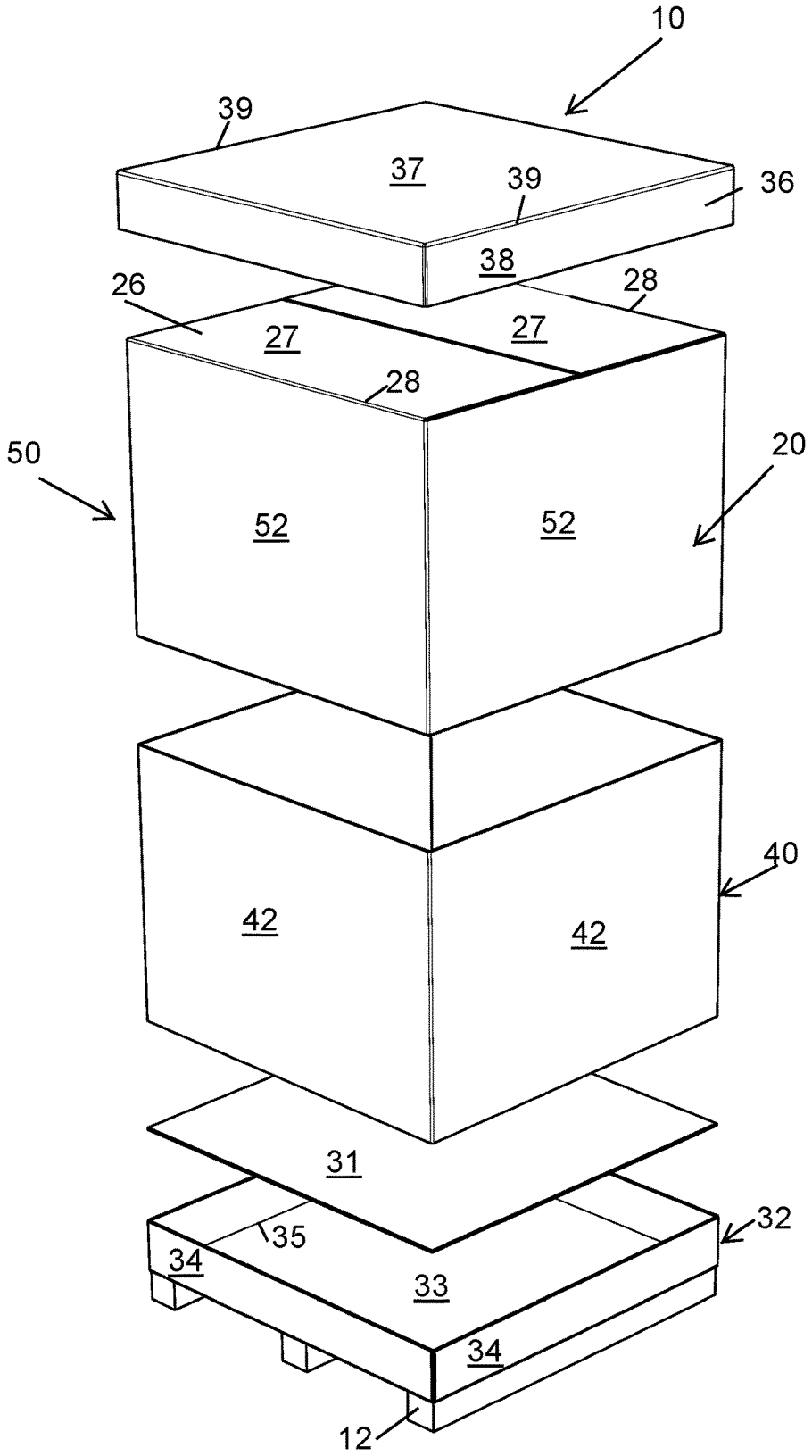
FIG. 11 is an exploded view of the packaging system of FIGS. 1 and 2.

FIG. 11 is an exploded view of the packaging system 10 showing from the bottom to the top:

the base 32 of the outer box 30 sitting on a pallet 12;

an auxiliary base plate 31 to support heavier items being stored and/or transported;

the side wall 40 of the outer box 30;

the inner box 20 erected and closed by the lid panels 27; and the lid 36 of the outer box 30.

As mentioned above the inner box 20 of the described embodiment is formed from a blank, which is shown in FIGS. 12(*a*) to (*c*).

FIG. 12(*a*) is a top view of a tube of a blank material, such as cardboard, from which the inner box 20 is formed, with the base panels 23, the side wall panels 52 and the lid panels 27 being aligned to form the tube. As noted above, the tube is formed by folding a blank having fold lines that separate side wall panels 52, base panels 23, and lid panels 27 into the tube shape shown in the Figure with opposed long side edges in contact and glued or otherwise connected together.

In the described embodiments the tube has a square perimeter of 1140 cm along each side of the square. However, the tube can be made in any other suitable shape, configuration and/or dimensions.

FIG. 12(*b*) shows the erected inner box 20 formed form the tube shown in FIG. 12(*a*), with the base panels 23 folded inwardly from the section of the tube that forms the side wall 50 to form the base 24 of the inner box 20, and with the lid panels 27 folded outwardly from the section of the tube that forms the side wall 50 to allow access to the inner box 20 as defined by the base 24 and the side wall 50.

In the described embodiment, the lid panels 27 extend outwardly from adjacent side wall panels 52 for about 570 cm, while the side wall panels 54 have a height of about 860 cm. The relative dimensions of the lid panels 27 and the side wall panels 54 are more clearly visible in FIG. 12(*c*).

The side wall panels 54 and the lid panels 27 can have any other suitable shape, configuration and/or dimensions.

FIG. 12(*c*) shows the tube shown in FIG. 12(*a*) in a folded-down form.

It is noted that to be housed in the flat pack as shown in FIG. 2, the folded down form of the inner box 20 shown in FIG. 12(*c*) must be folded at least one more time in order to fit within the base 32 of the outer box 30.

The folded down form of the inner box 20 shown in FIG. 12(*c*) can be folded one or more times along any of (i) folds lines 24 separating the base panels and the side wall panels 52 (ii) fold lines 28 separating the lid panels and the side wall panels 52 (i) fold lines 54 separating the side wall panels 52 from each other.

Figure 13:
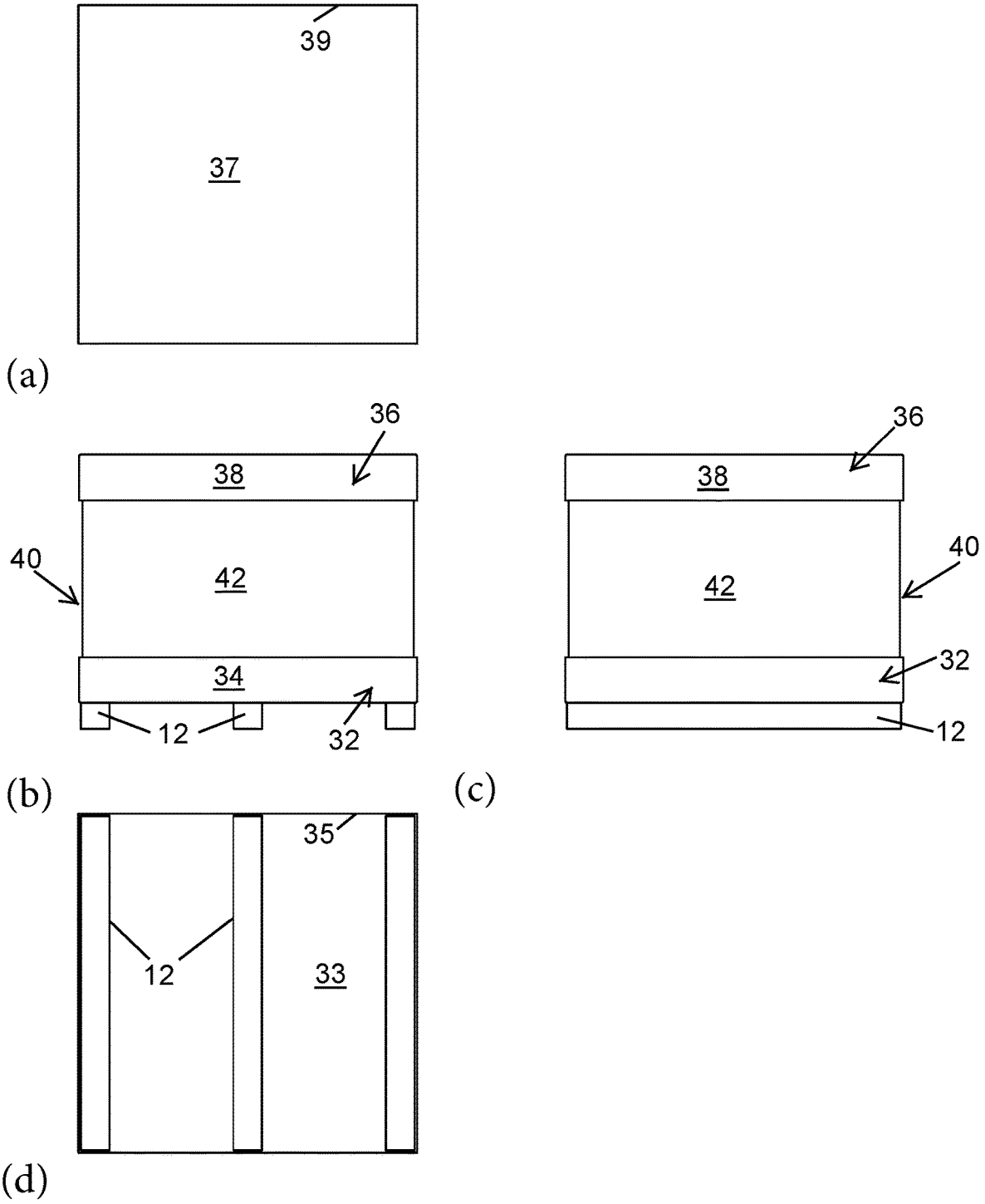
FIG. 13(*a*) is a top view of the outer box.

The outer box 30, is shown in more detail in FIGS. 13(*a*) to (*d*).

FIGS. 13(*a*) to (*d*) are, respectively, (a) a top view, (b) a front view, (c) a side view and (b) a bottom view of the outer box 30 sitting on a pallet 12.

Figure 14:
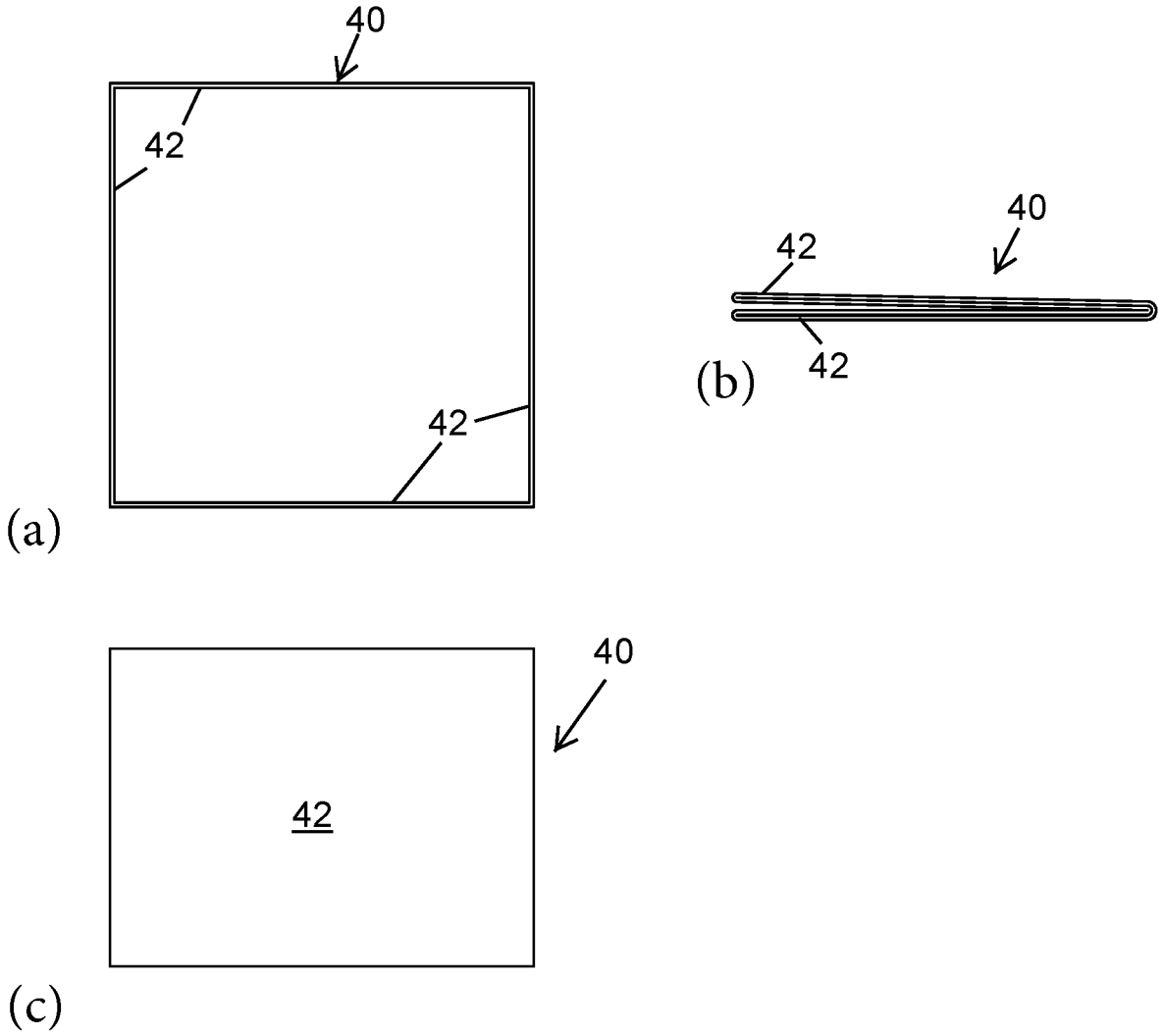
FIG. 14(*a*) is a top view of the side wall of the outer box in an erected form.
Figure 15:
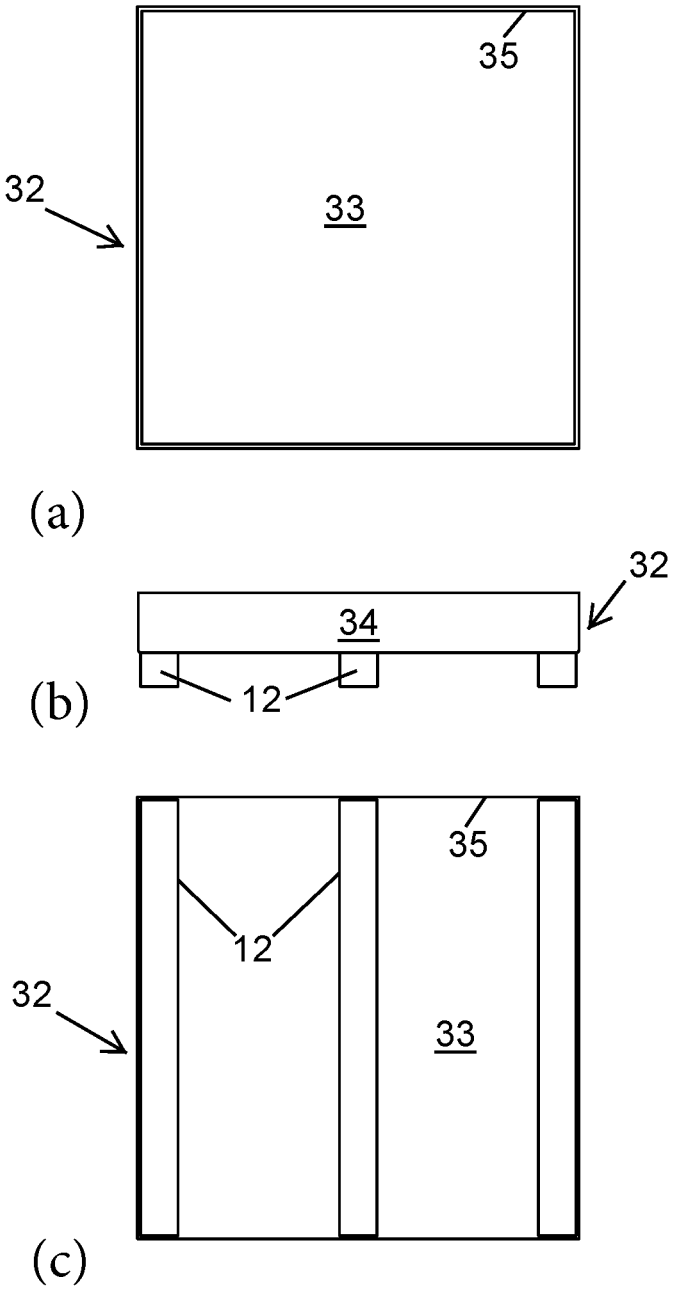
FIG. 15(*a*) is a top view of the base of the outer box.
Figure 16:
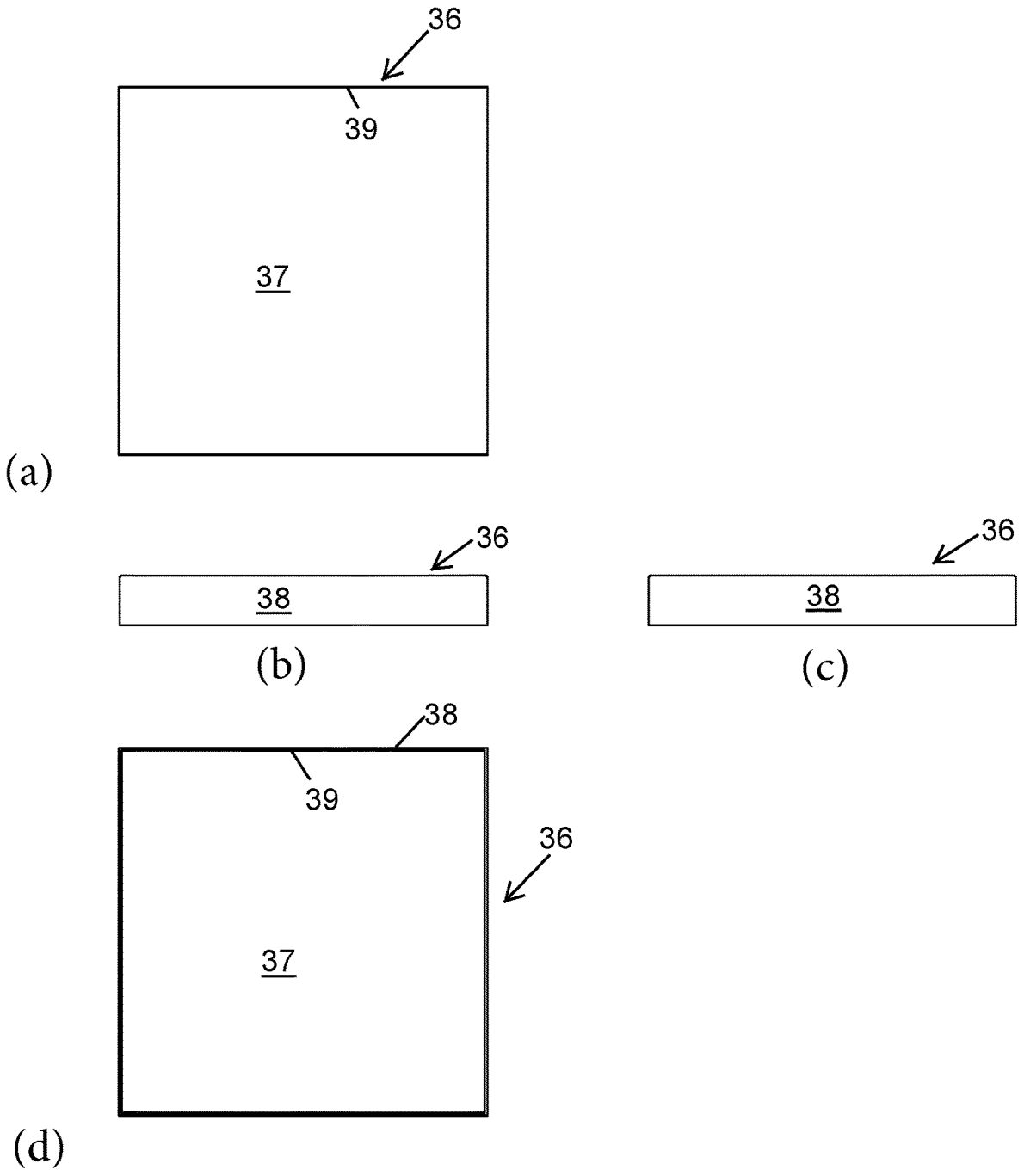
FIG. 16(*a*) is a top view of the lid of the outer box.

The outer box 30 is shown in more details in FIGS. 14 to 16.

In particular, FIG. 14(*a*) shows a top view of the erected side wall 40 of the outer box 30 defining a square perimeter of 1146 cm along each side of the square. Typically, the side wall 40 is formed from cardboard. The dimensions of the perimeter of the side wall 40 are selected so that, in use, the inner box 20 is housed snugly in the outer box 30.

In the described embodiment, the perimeter of the side wall 40 of the outer box 30 is slightly larger than the perimeter of the side wall 50 of the inner box 20.

The dimensions of the perimeter of the side wall 40 of the outer box 30 is also selected so that the perimeter wall 38 of the lid 36 of the outer box 30 and the perimeter wall 34 of the base 32 of the outer box 30 are located outwardly of the side wall 40 of the outer box 30.

In the described embodiment, a side of the perimeter of the side wall 40 of the outer box 30 is 1146 cm.

However, the side wall 40 of the outer box 30 can be built in any other suitable shape, configuration and/or dimensions.

FIG. 14(*b*) shows a folded-down form of the side wall 40 of the outer box 30 that is housed in the flat pack.

FIG. 14(*c*) is a side view of the side wall 40 of the outer box 30 showing a side wall panel 42 having a height of 846 cm. The height is selected taking in consideration the thickness of the lid panel 37 and the base panel 33 of the outer box 30 so that the inner box 20 can be, in use, housed in the outer box 30.

FIGS. 15(*a*) to (*c*) are (a) a top view, (b) a front view and (c) a bottom view of the base 32 of the outer box 30 sitting on a pallet 12.

The height of the perimeter wall 34 of the base 32 of the outer box 30 is, in the described embodiment, approximately 160 cm and a side of the perimeter wall 34 of the base 32 of the outer box 30 is approximately 1160 cm.

FIGS. 16(*a*) to (*d*) are (a) a top view, (b) a front view, (c) a side view and (d) a bottom view of the lid 36 of the outer box 30.

The height of the perimeter wall 38 of the lid 36 of the outer box 30 is in the described embodiment, approximately 160 cm.

The dimensions of the perimeter wall 38 of the lid 36 of the outer box 30 are selected so that, when the packaging system 10 is a flat pack, the lid 36 of the outer box 30 can be positioned on the base 32 of the outer box 30 with the perimeter wall 38 of the lid 36 located outwardly of the perimeter wall 34 of the base 32 of the outer box 30.

This allows for the packaging system 10 to be carried in a compact form to the location where the items to be stored and/or transported are located.

The dimensions of each of the components of the packaging system 10 can be tailored as desired. For example, the size of the inner box 20 and the outer box 30 can be selected with regards to type and size of the items 60 to be stored and/or transported.

Modifications within the scope of the invention may be readily made by those skilled in the art. It is to be understood, therefore, that this invention is not limited to the particular embodiments described by way of example hereinabove.

It is to be understood that the reference to prior art herein does not constitute an admission that such prior art forms a part of the common general knowledge in the art, in Australia or any other country.

In the claims that follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A packaging system including:

(a) an inner box that is adapted to receive items to be transported, the inner box including a base, a side wall and a lid, and (b) an outer box that is adapted to house the inner box, the outer box including a base, a side wall and a lid, wherein the base and the lid of the outer box are adapted to form a flat pack that houses a folded-down form of the inner box and a folded-down form of the side wall of the outer box for transport within the flat pack, whereby in use the folded-down form of the inner box is removed from the flat pack and assembled to form the inner box and the folded-down form of the side wall of the outer box is removed from the flat pack and assembled together with the base and the lid of the outer box to form the outer box.

2. The packaging system of claim 1, wherein the side wall of the outer box is in the form of a sleeve that includes a plurality of side wall panels separated by fold lines, wherein the side wall panels can be folded flat and can also be erected to define the side wall of the outer box.

3. The packaging system of claim 1, wherein the base of the outer box includes a base panel and a perimeter wall extending from an outer edge of the base panel.

4. The packaging system of claim 3, wherein the dimensions of the base of the outer box and the side wall of the outer box are selected so that the side wall of the outer box can be inserted into and received within the perimeter wall of the base of the outer box.

5. The packaging system of claim 1, wherein the lid of the outer box includes a lid panel and a perimeter wall extending from an outer edge of the lid panel.

6. The packaging system of claim 5, wherein the dimensions of the perimeter wall of the lid of the outer box and the dimensions of the side wall of the outer box are selected so that the lid can be positioned to close the outer box with the perimeter wall of the lid located outwardly of the side wall of the outer box.

7. The packaging system of claim 5, wherein the dimensions of the perimeter wall of the base of the outer box and the perimeter wall of the lid of the outer box are selected so that the lid can be positioned on the base to form the flat pack with the perimeter wall of the lid located outwardly of the perimeter wall of the base.

8. The packaging system of claim 1, wherein the side wall of the inner box is in the form of a sleeve that includes a plurality of side wall panels separated by fold lines, wherein the side wall panels can be folded flat and can also be erected to define the side wall of the inner box.

9. The packaging system of claim 8, wherein the base of the inner box includes base panels extending from the side wall panels of the side wall of the inner box and separated from the side wall panels by fold lines, the base panels being adapted to be folded to form the base of the inner box.

10. The packaging system of claim 8, wherein the lid of the inner box includes lid panels extending from the side wall panels of the side wall of the inner box, the lid panels being adapted to be folded to form the base of the inner box.

11. A flat pack comprising the packaging system of claim 1.

12. A method of packaging items, the method comprising:

(a) opening the flat pack of the packaging system defined in any one of the preceding claims either before or after step (b);

(b) assembling together the base of the inner box and the side wall of the inner box of the packaging system defined in any one of the preceding claims, so that the side wall of the inner box extends upwardly form the base of the inner box to form a partially assembled inner box;

(c) assembling together the base of the outer box and the side wall of the outer box of the packaging system defined in any one of the preceding claims, so that the side wall of the outer box extends upwardly form the base of the outer box to form a partially assembled outer box;

(d) inserting the partially assembled inner box described in step (b) in the partially assembled outer box described in step (c) either before or after step (e), (e) positioning items to be transported in the partially assembled inner box and closing the inner box with the lid of the inner box, and (f) closing the partially assembled outer box with the lid of the outer box.

13. The method of claim 12, wherein step (b) comprises assembling the inner box by unfolding and opening the folded-down form of the inner box to form a tube and folding the base panels of the inner box to form the base of the inner box, thereby defining an erected form of the side wall of the inner box.

14. The method of claim 12, wherein step (c) comprises assembling the outer box by opening the side wall of the outer box from the folded-down form to an erected form and inserting the side wall into the base of the outer box.

15. The method of claim 12, further comprising, after step (b), securing together the base of the inner box and the side wall of the inner box with a fastener.

16. The method of claim 12, further comprising, after step (e), securing together the lid of the inner box and the side wall of the inner box with a fastener.

17. The method of claim 12, further comprising, after step (e), securing together the lid of the inner box and the side wall of the outer box with a fastener.

18. The method of claim 12, further comprising, after step (f), securing together the base of the outer box, the lid of the outer box and the side wall of the outer box with a fastener.

19. Packaged items in a closed inner box positioned within a closed outer box formed from the packaging system defined in claim 1 in accordance with the method defined in claim 12.

* * * * *